United States Patent [19]

Asagi et al.

[11] Patent Number: 4,777,987

[45] Date of Patent: Oct. 18, 1988

[54] OUTER STAY OF HEALD FRAME FOR LOOM

[75] Inventors: Kousaku Asagi, Shiga; Yoshifumi Nakano; Akiko Nakazono, both of Osaka, all of Japan

[73] Assignee: Sumitomo Chemical Company, Limited, Osaka, Japan

[21] Appl. No.: 112,169

[22] Filed: Oct. 26, 1987

[30] Foreign Application Priority Data

Oct. 24, 1986 [JP] Japan ..... 61-254339

[51] Int. Cl.[4] ..... D03D 9/00

[52] U.S. Cl. ..... 139/91

[58] Field of Search ..... 139/91, 92

[56] References Cited

U.S. PATENT DOCUMENTS

| | | | |
|---|---|---|---|
| 3,604,469 | 9/1971 | Schneiter et al. | 139/91 |
| 4,307,757 | 12/1981 | Shimizu | 139/91 |
| 4,633,916 | 1/1987 | Rast | 139/92 |

*Primary Examiner*—Henry S. Jaudon

*Attorney, Agent, or Firm*—Sughrue, Mion, Zinn, Macpeak, and Seas

[57] ABSTRACT

An outer stay of heald frame for loom is disclosed, comprising a core material having wrapped thereon a strengthening layer of a fiber reinforced resin in the longitudinal direction in such a way that continuous fibers in the strengthening layer are positioned one on top of another. This outer stay is lightweight, has high rigidity, and offers superior tensile strength and fatigue strength.

4 Claims, 1 Drawing Sheet

OUTER STAY OF HEALD FRAME FOR LOOM

FIELD OF THE INVENTION

The present invention relates to an outer stay of heald frame for loom.

BACKGROUND OF THE INVENTION

A heald frame for loom is used for suspending a number of healds through which warps pass and being subjected to high-speed shedding motion on the loom so as to produce fabrics. The heald frme is required to be made of a material that has sufficient rigidity and strength so that it is not deformed or broken even if it undergoes rapid motion while being subjected to a tension of the number of warps. For this reason, fragile materials such as wood are not suitable for use as the material of heald frame although they are lightweight. Most of the conventionally employed heald frames are therefore made of metallic materials such as iron, stainless steel, aluminum alloys, and magnesium alloys.

Recent advances in the technology of high-speed weaving using, e.g., air-jet looms, have been remarkable, and the demand for moving the healds at higher speeds is continuously growing. Heavy metallic materials are limited in improving the speed, the active efforts are underway to find materials that are lighter in weight and which have greater strength and rigidty than metallic materials.

One approach toward this end is to use carbon fiber-reinforced plastics (hereinafter referred as CFRP) having high levels of specific strength and specific rigidity, and it has been proposed in Japanese patent application (OPI) No. 43457/72 to employ CFRP in a heald frame which supports healds or droppers or a dropper rod. (The term "OPI" as used herein means an "unexamined published application".) This patent, however, does not at all take into consideration the employment of CFRP in an outer stay of heald frame. The heald frame shown in this patent is one formed by laminating and adhering carbon fibers or a composite material thereof in the longitudinal direction. However, this proposed idea is not completely satisfactory because the strength potential of carbon fibers or composite material thereof is not exploited to the fullest extent.

SUMMARY OF THE INVENTION

An object of the present invention is to provide an outer stay of heald frame for loom that is free from the above-described defects of the prior art techniques.

The outer stay of the present invention is very light in weight and has high rigidity. In addition, it has superior tensile strength and fatigue strength. A heald frame equipped with this outer stay causes reduced damages to warps and permits the loom to be operated at a very high speed. An additional advantage that is offered by the outer stay is that the loom can be operated with a smaller-sized drive mechanism to achieve reduction in power consumption and noise.

DESCRIPTION OF THE PREFERRED EMBODIMENT

An outer stay of heald frame of the present invention comprises a core material having wrapped thereon a strengthening layer of a fiber reinforced resin in the longitudinal direction in such a way that continuous fibers in the strengthening layer are positioned one on top of another.

Having this structure, the outer stay of the present invention has a greater degree of tensile strength and fatigue strength than those which are composed by merely laminating reinforcing fibers one on top of another and subsequently bonding them together with an adhesive.

The present invention is hereinafter described in great detail.

Figure 1:
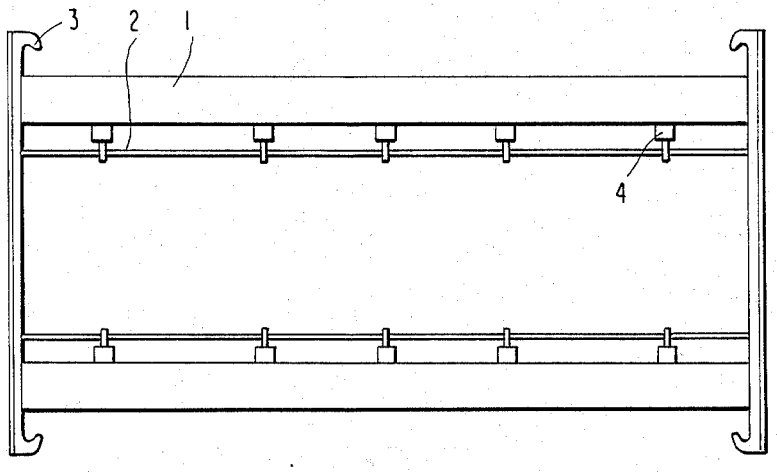
FIG. 1 is a front view of a heald frame for loom.

FIG. 1 is a front view of a heald frame for loom, which consists of heald staves 1, heald rods 2, outer stays 3, and middle hooks 4.

Figure 2:
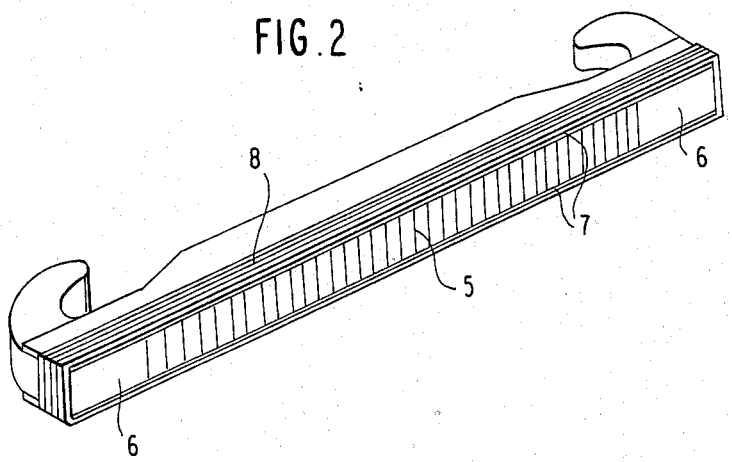
FIG. 2 is a perspective view of one example of an outer stay of heald frame according to the present invention.

FIG. 2 is a perspective view of one example of an outer stay according to the present invention, which consists of a core material 5, hanger portions 6 bonded to each end of the core material 5 with an adhesive, surface strips 7 attached to the core material 5 and hanger portions 6 from opposite sides to form a unitary member, and a fiber reinforced resin layer 8 that is wrapped around the core material 5 in the longitudinal direction in such a way that the continuous fibers in the layer 8 are positioned one on top of another, the layer 8 being bonded to the surface strips 7 and hanger portions 6 with an adhesive. The surface strips 7 are not an essential member but are preferably provided in order to ensure higher strengths.

The outer stay described above can be fabricated by the following procedures.

The core material 5 is made of a lightweight material having a specific gravity of not higher than 1, such as a honeycomb sandwiched sheet, wood, or a plastic foam. Such a lightweight material is formed and machined to a desired shape in advance. The hanger portions 6 are preferably made of a material having a high strength and hardness, such as an aluminum alloy, iron, stainless steel, a magnesium alloy, titanium, or an isotropic fiber reinforced resin. In order to reduce the weight, an isotropic laminate of a fiber reinforced resin such as CFRP is preferred.

The hanger portions 6 are provided at both ends of the core material 5 in the longitudinal direction. If desired, the surface strips 7 are attached to the core material 5 and hanger portions 6 from opposite sides, which are bonded together with an adhesive to form a unitary member. The surface strips 7 are preferably made of a lightweight and strong material which may be the same as the material of which the fiber reinforced resin layer 8 is made. It should, however, be noted that the surface strips 7 may be made of other materials.

In the next step, the fiber reinforced resin layer 8 is wrapped around the core material 5 in the longitudinal direction in such a way that the continuous fibers in the layer 8 are positioned one on top of another.

The continuous reinforcing fibers in the layer 8 are typically inorganic fibers such as carbon fibers, graphite fibers, alumina fibers, silicon carbide fibers, silica fibers, boron fibers, or glass fibers; organic fibers such as aromatic polyamide fibers, aromatic polyester fibers, or high-strength polyethylene fibers; or metallic fibers. These fibers can be used either individually or in combination. Among them, carbon fibers are particularly preferred.

The matrix resin is typically selected from among thermosetting resins such as epoxy resins, phenolic resins, alkyd resins, urea-formaldehyde resins, polyester resins, aromatic polyamide resins, polyamide-imide resins, polyester-imide resins, polyimide resins, polybenzothiazole resins, and silicon resins; and thermoplastic resins such as polyethylene, polypropylene, polymethyl methacrylate, polystyrenes (including high-impact polystyrene), polyvinyl chloride, ABS resin, styrene-acrylonitrile polymer, polyamides (e.g., nylon 6, nylon 6/6, nylon 6/10, nylon 6/11, and nylon 6/12), polyacetals, polysulfones, polycarbonates, polyphenylene oxides, polyether sulfones, and polyether-ether ketone.

The fiber reinforced resin layer can be prepared by one of the following methods. In a first method, a prepreg tape of a given width in which reinforcing fibers are aligned in one direction in a thermosetting resin matrix (e.g., Magnamite ®AS-4/1908 of Sumika-Hercules Co., Ltd.) is wound around a core material under tension until the tape is laid up in layers to a predetermined thickness, and the core with laminated layers of the prepreg tape is set in a mold cavity and heated while applying a pressure from the thickness direction until the resin cures. In a second method, a prepreg tape of a given width in which reinforcing fibers are aligned in one direction in a thermoplastic resin matrix (e.g., Spiflex ®CF/Nylon of Spiflex Inc.) is wound around a core material under tension as the tape is heated, melted, and fused to the core. A third method is what is generally referred to as the filament winding method in which fiber strands are impregnated with a resin as they are wound around a core material, and the wound fibers are subsequently heated to cure the resin.

The most important feature of the present invention is that an outer stay of heald frame is composed of a core material around which continuous reinforcing fibers are wound to form a laminate in the longitudinal direction. In the resulting outer stay, the core material joins strongly to the hanger portions at both ends to form a unitary assembly that offers higher levels of tensile strength and fatigue strength. The outer stay of the present invention is subsequently joined to other members such as heald staves and heald rods and assembled together to construct a heald frame for loom. In this case, the overall weight of the heald frame can be effectively reduced if the heald staves are formed of a lightweight, high-strength, and high-rigidity material such as a honeycomb sandwiched sheet, a hollow fiber reinforced resin sheet, or a hollow aluminum alloy sheet.

The following examples are provided for the purpose of further illustrating the present invention but are in no way to be taken as limiting its scope.

EXAMPLE 1

Four sheets of unidirectional carbon fiber reinforced epoxy prepreg with an areal fiber density of 200 g/m$^2$ (Magnamite ®AS-4/1908.HP-200000 of Sumika-Hercules Co., Ltd.) were stacked one on top of another to produce a $(0°, 0°, 90°, 0°)_T$ laminate measuring 0.8 mm thick and 700 mm per side. Two of such laminates were pressed together by a conventional process to make a CFRP sheet.

An aluminum honeycomb sheet 5.9 mm thick (Hibeck Score ®$\frac{3}{8}$-10N-52D of The Yokohama Rubber Co., Ltd.) was cut to a size of 634 mm×700 mm. The CFRP sheet prepared in the previous step was bonded with a film adhesive to both sides of this honeycomb sheet in such a way that the shorter side of the latter would be oriented parallel (forming an angle of 0°) with respect to the fiber direction and that equal areas would be left uncovered with the honeycomb sheet on both ends of the CFRP sheet.

The resulting CF/Al honeycomb composite was cut to a width of 37 mm in such a way that its longitudinal direction would become parallel to the fiber direction, and the bases of hanger portions 6 that were made of an aluminum alloy were fitted over both ends of the CF/Al honeycomb composite where no honeycomb sheet was provided. The base of each of the hanger portions was joined to the CF/Al honeycomb composite with an adhesive.

A prepreg tape 16 mm wide that was made of the same material as what was used to make the surface sheets or strips of the honeycmb composite was wound around the core material (i.e., honeycomb composite) in three layers with tension being applied at a preselected position.

Subsequently, a polyethylene terephthalate (PET) film 16 mm wide was wrapped around in five layers. This PET film would serve both as a release sheet and to impart pressure to both ends of the honeycomb composite. The assembly was set in a mold cavity and hot pressed (120° C.×6 kg/cm$^2$) for 60 minutes to cure the resin. The outer stay recovered from the mold weighed 170 g, which was only 34% of the weight of an outer stay of the same configuration that was totally made of an aluminum alloy. This outer stay was subjected to a tensile test by applying a tensile load to the hanger portions. The first layer on the core material did not break even at a tensile load of 500 kgf and proved to perform as satisfactorily as an outer stay totally made of an aluminum alloy.

Two units of this outer stay were joined to heald staves made of a CF/Nomex ® (a product of E. I. DuPont de Nemours and Company) honeycomb sheet and assembled with heald rods and other necessary members to construct a heald frame of the type shown in FIG. 1. The constructed heald frame weighted 2.2 kg, which was one half the weight of a heald frame that was totally made of an aluminum alloy.

COMPARATIVE EXAMPLE 1

An outer stay was fabricated as in Example 1 except that three layers of Magnamite ®AS-4/1908.HP-200000 prepreg tape cut to a length of 700 mm were laminated on the surface strips of the honeycomb composite rather than being wound thereabout.

The outer stay was subjected to a tensile test as in Example 1 and at a tensile load of not higher than 400 kgf, the hanger portions separated from the core material and the first layer on the latter broke.

EXAMPLE 2

The honeycomb core used in Example 1 was replaced by a core material in the form of plywood (specific gravity: 0.6) that was cut to a size of 7.5 mm×37 mm×634 mm. Hanger portions made of an isotropic carbon fiber reinforced resin (CFRP) were butted against both ends of the core material and bonded thereto with an adhesive. A 16.5 mm wide carbon fiber/nylon Spiflex ® tape (a product of Spiflex Inc., areal fiber density: 200 g/m$^2$) was subsequently wound around the core material in four layers in the longitudinal direction with a tension of 2 kgf being applied to the tape as it was fused by locally heating at 275° C. The resulting outer stay weighed 180 g. In the tensile test, the first layer on the core material did not break at a load of 500 kgf, and this showed a high performance potential of the outer stay.

Two units of this outer stay were combined with draw-formed heald staves of hollow glass fiber reinforced resin to construct a heald frame as in Example 1. The so constructed heald frame weighted 2.9 kg.

EXAMPLE 3

The plywood used in Example 2 was replaced by a core material in the form of a rigid urethane foam having a specific gravity of 0.8. Hanger portions made of an isotropic carbon fiber reinforced resin (CFRP) were butted against both ends of the core material and bounded thereto with an adhesive.

A hundred parts by weight of Sumiepoxy ®ELA128 (a product of Sumitomo Chemical Co., Ltd.), 85 parts by weight of an acid anhydride-based curing agent (HN 5500 of Hitachi Chemical Co., Ltd.), and 1 part by weight of a curing catalyst (Sumicure ®-D of Sumitomo Chemical Co., Ltd.) were mixed to prepare a filament winding resin.

Strands of Kevlar ®40 (a product of E. I. Du Pont de Nemours and Company) were impregnated with the filament winding resin to make a tape having a fiber volume fraction of 60% and measuring 16.5 mm in width. The tape was then wound around the core material in 6 layers in the longitudinal direction. The assembly was cured by heating in an oven at 80° C. for 6 hours.

The so fabricated outer stay weighed 240 g and was found to have a high performance potential when it was subjected to the tensile test as in Example 2.

As in Example 1, two units of this outer stay were joined to heald staves made of a CF/Nomex ® (a product of E. I. Du Pont de Nemours and Company) honeycomb sheet and assembled with heald rods and other necessary members to construct a heald frame of the type shown in FIG. 1. The constructed heald frame wieghed only 2.35 kg.

While the invention has been described in detail and with reference to specific embodiments thereof, it will be apparent to one skilled in the art that various changes and modifications can be made therein without departing from the spirit and scope thereof.

What is claimed is:

1. An outer stay of heald frame for loom, comprising a core material having wrapped thereon a strengthening layer of a fiber reinforced resin in the longitudinal directon in such a way that continuous fibers in the strengthening layer are positioned one on top of another.

2. An outer stay according to claim 1, wherein the core material is selected from among a honeycomb sandwiched sheet, wood, and a plastic foam, all having a specific gravity of no more than 1.

3. An outer stay according to claim 1, wherein the matrix of the fiber reinforced resin is selected from among an epoxy resin, a phenolic resin, an alkyd resin, a urea-formaldehyde resin, a polyester resin, an aromatic polyamide resin, a polyamide-imide resin, a polyesterimide resin, a polyimide resin, a polybenzothiazole resin, a silicon resin, polyethylene, polypropylene, polymethyl methacrylate, a polystyrene, polyvinyl chloride, ABS resin, styrene-acrylonitrile polymer, a polyamide, a polyacetal, a polysulfone, a polycarbonate, a polyphenylene oxide, a polyether sulfone, and polyetherether ketone.

4. An outer stay according to claim 1, wherein the reinforcing fiber in the fiber reinforced resin is at least one member selected from the group consisting of carbon fibers, graphite fibers, alumina fibers, silicon carbide fibers, silica fibers, boron fibers, glass fibers, aromatic polyamide fibers, aromatic polyester fibers, high-strength polyethylene fibers, and metallic fibers.

* * * * *